US006575460B2

(12) United States Patent
Vollman et al.

(10) Patent No.: US 6,575,460 B2
(45) Date of Patent: Jun. 10, 2003

(54) DEVICE AND METHOD FOR FEEDING OBJECTS

(75) Inventors: Andreas Vollman, Ludwigsburg (DE); Andreas Horeld, Ludwigsburg (DE); Bernhard Mokler, Märkgröningen (DE)

(73) Assignee: LTG Mailander GmbH (DE)

( * ) Notice: Subject to any disclaimer, the term of this patent is extended or adjusted under 35 U.S.C. 154(b) by 0 days.

(21) Appl. No.: 09/826,322

(22) Filed: Apr. 4, 2001

(65) Prior Publication Data

US 2002/0008003 A1 Jan. 24, 2002

(30) Foreign Application Priority Data

Apr. 6, 2000 (DE) ..... 100 17 259

(51) Int. Cl.[7] ..... B65H 5/34

(52) U.S. Cl. ..... 271/270; 271/275; 271/276; 271/197

(58) Field of Search ..... 271/275, 276, 271/270, 193, 197, 202, 203, 245, 246, 182, 183; 198/462.1, 690.1

(56) References Cited

U.S. PATENT DOCUMENTS 3,380,734 A * 4/1968 Laumer ..... 271/202
3,507,489 A * 4/1970 Wilshin et al. ..... 271/202
4,451,027 A * 5/1984 Alper ..... 271/270
4,651,984 A * 3/1987 Emrich ..... 271/276
5,133,543 A * 7/1992 Eitel et al. ..... 271/276
5,221,079 A * 6/1993 Most et al. ..... 271/202
5,569,016 A * 10/1996 Mokler ..... 271/182
5,613,675 A * 3/1997 Kruger et al. ..... 271/270
6,305,285 B1 * 10/2001 Steven ..... 271/276

FOREIGN PATENT DOCUMENTS

DE 1152 707 12/1961
DE 196 45 239 A1 11/1996
EP 0324900 * 7/1989 ..... 271/202

* cited by examiner

*Primary Examiner*—David H. Bollinger
(74) *Attorney, Agent, or Firm*—Morriss, Bateman, O'Bryant & Compagni

(57) ABSTRACT

The invention relates to a method and a device for feeding flat objects overlapping in slats, particularly metal sheets, at least to a front edge stopper of a processing machine, particularly a tin printing machine or a tin-plate varnishing machine, with a first conveyor on which the objects lie. It is provided for the first conveyor (5) to exhibit a constant speed or a speed that changes in cycles ($v_1$) and for a second conveyor (6) to be arranged between the first conveyor (5) and the front edge stopper (3), with said second conveyor being designed as a continuously rotating run (8) which takes over each frontmost object (4') from the first conveyor (5) at a speed corresponding ($v_1$) to that of the first conveyor (5) and slows it down to a lesser speed ($v_2$), and at this delayed state, feeds it to the front edge stopper (3) through subsequent sliding of the object on a base (27) or through delivery to a device (28), with the device (28) leading the object to rest on the front edge stopper (3), or that the run (8) slows down the object (4') until it comes to a standstill, as a result of which it is led to the front edge stopper (3).

18 Claims, 3 Drawing Sheets

DEVICE AND METHOD FOR FEEDING OBJECTS

RELATED APPLICATIONS

The present application claims priority to German Patent Application 10017259.8, filed Apr. 6, 2000.

BACKGROUND

This application claims priority to German Application No. 10017259.8, filed Apr. 6, 2000.

The invention relates to a device for feeding flat objects that overlap in slats, particularly metal sheets, to at least a front edge stopper of a processing machine, particularly a tin printing or a tin-plate varnishing machine, with a first conveyor on which the objects lie. In a known device, the speed of the entire feed belt system is reduced in cycles to slow down the objects arranged in slats. As a result, all the sheets that overlap in slats slow down simultaneously, in the course of which the frontmost sheet is placed against the front edge stopper. From there, the sheet is delivered in a position-determined manner by means of another transport system. The remaining panels are again cyclically accelerated until the frontmost panel has reached a certain position, at which point the slowdown is again carried out. The disadvantage of this system is that very large masses must be accelerated and slowed down, so that the accuracy of the position of the frontmost panel in the target braking area greatly diverges on account of belt elasticity and other parameters that exert influence. There is therefore no certain, reproducible front edge equipment of the sheet metals.

Furthermore, devices with delaying elements are known, with which a panel delay is effected through friction. The disadvantage here is the poor accuracy due to the slippage action that is hard to reproduce, which, in the target braking area, in the process of transferring to the front edge stopper, may cause too great a residual velocity when it stops (damage problem) or too much of a delay (no sufficient arrangement of the front edge of the sheet). Furthermore, it is disadvantageous that, in the conveyor, during the breaking process, the holding surface is reduced when the next metal sheet goes under. In an unfavorable case, the holding surface is reduced to zero, so that an undefined slippage occurs in the last brake phase.

The problem that the invention seeks to solve is to create a device for feeding flat objects that overlap in slats, of the type mentioned at the start, which allows a precise, reproducible arrangement of the particular front edge of the metal sheets at the front edge stopper. Moreover, a high cycle count can be realized.

This task is solved according to the invention by having the first conveyor exhibit a constant speed or a speed that changes in cycles, and a second conveyor arranged between the first conveyor and the front edge stopper, with the said second conveyor being designed as a continuously rotating run and which takes over each frontmost object from the first conveyor at a speed that matches that of the first conveyor, and slows it down to a lesser speed, particularly almost to a standstill, and in this delayed state, feeds it to the front edge stopper through subsequent sliding of the object on a base or delivery to a device, in which the device leads the object to rest on the front edge stopper, or that the run slows down the object until it comes to a standstill, to the extent that it is led up to the front edge stopper. This method results in a precise sheet alignment without damage to the corners. The objects lying in slats on the first conveyor are consequently continuously transported at constant speed. A slat transport with constant speed thus takes place. Alternatively, a speed that changes in cycles can also be designed. A speed that changes in cycles means high speed, low speed, high speed, low speed, etc., in which the speed ratio preferably lies in the range of 4:1 to 2:1, and in particular, 3:1. The frontmost metal sheet in the slat—as seen from the transport direction—is slowed down by mean of the second mean of conveyance, to the extent that it bumps into the front edge stopper at a low residual speed or that it is delivered with the low residual speed to the device, which leads it to the front end stopper. Alternatively, the slowdown can also take place through the second conveyor in such a way that the metal sheet is led from the second conveyor up to the front edge stopper where it comes to a standstill. While the frontmost sheet is decelerated, the slatted arrangement of the remaining sheets is constantly moved further by means of the first conveyor. It is also alternatively conceivable for the lamellar flow of the first conveyor to be transported in cycles. This means making a change of speed in cycles: high speed, low speed, etc. If the frontmost sheet is precisely aligned, it is taken over by a processing mechanism in a precisely aligned position. During the mentioned aligning process, the second conveyor again accelerates to a speed that corresponds to that of the first conveyor so that afterwards, the current frontmost metal sheet of the slat arrangement is taken over by the second conveyor and, as previously described, is slowed down and precisely aligned to the front edge stopper. Each frontmost sheet preferably lies on the second conveyor, and during the slowdown, no relative movement takes place between the second conveyor and the metal sheet, thereby providing an exact reproducibility. During the slowdown, no sliding movement develops in the main phase between the second conveyor and the metal sheet. The metal sheet is precisely slowed down with the second conveyor (side belt), corresponding to an established law of motion which occurs in the same place—machine angle—for each cycle. The following preferably provided holding action through vacuum, which is defined in greater detail, is designed in such a way that the course of the curve of the slowdown is independent of the weight of the sheet and of the surface condition of the metal sheet. The movement of the second conveyor and the metal sheet is synchronous in the slowing down phase, without relative movement. Only shortly before the arrival at the front edge stopper, especially at the front marks, is this frictional connection (by switching off the vacuum) neutralized so that the second conveyor still pushes the metal sheet, but only with a very slight force arising from the existing friction without vacuum between the run and the metal sheet. The scaling is done during the slowing-down process of the frontmost sheet in such a way that the overlapping zone with the subsequent sheet increases. Appropriately adopting the speed of the two conveyors while taking into account the sizes of the respective objects to be fed allows for a high processing number per time unit. The objects lie on the first and the second conveyor, i.e., the objects are above the conveyors; there is therefore no overhead transport in which the objects are held on the underside of the conveyors. This is important, among other things, because the arrangement of the objects in slats is in such a way that the frontmost sheet is grasped from underneath by the subsequent one, etc., so that the sheets are solely accessible from below only in the non-overlapped area.

As mentioned, a slowdown up to a relatively low speed follows according to the invention. Once the object has accepted this low speed, it slides a little bit over the base, and in this manner, reaches the front edge stopper and is aligned there. Alternatively, it is also possible for the object—after the slowdown—to be taken over by another device that grasps the object (through a gripper device, suction device, and/or magnetic device) and leads it precisely up to the front edge stopper so that the alignment takes place there. Alternatively, it is also possible for the second conveyor to decelerate the object until it comes to a standstill, in which the slowdown occurs in such a way that, when the object is at a standstill, or shortly before it comes to a standstill, it bumps into the front edge stopper, causing it become aligned.

A further embodiment of the invention provides for a first retaining device to be allocated to the first conveyor. A second retaining device can preferably be allocated to the second conveyor. The first and/or the second holding device can preferably be designed as a suction device and/or as a magnetic device. The suction device is designed in such a way that the objects, particularly the metal sheets, are held against the surface of the conveyor through a suction effect, thereby definitely avoiding a relative movement between the corresponding conveyor and the objects. In particular, because of the holding action, the braking process can be carried out without the metal sheet slipping on the conveyor, thereby achieving a high precision at a high number of cycles. Insofar as the objects are ferromagnetic components, for instance, steel sheets, a magnetic device can also be used as a holding device, with said magnetic device being found underneath the conveyor, and by this method, preventing a relative dislocation between the metal sheet and conveyors. The metal sheets consequently move precisely with the speed which is specified by the corresponding conveyor.

In particular, the first conveyor can be provided as a continuously running conveyor. The first and second conveyors are consequently runs which preferably consist of several belts that lie parallel side by side, on which the metal sheets lie, with the holding device arranged underneath the top run, with the metal sheet or metal sheets holding the said holding device in place on the belts.

Furthermore, it is advantageous when the second holding device—as seen from the transport direction—extends only over a section of the second conveyor. This section is sufficient for a positioning and keeps the positioning zone relatively small so that only correspondingly small quantities of energy are to be applied for the holding action.

Furthermore, it is advantageous when the second holding device is essentially on the power-side half of the second conveyor.

It is particularly preferred when the holding action of the second holding device can be switched on and off. In the case of a vacuum suction device, the vacuum source can be switched on and off or there is a pneumatically operative on-off valve in the system, with which the suction effect can be switched on and off. The suction effect is activated as soon as the frontmost metal sheet is taken over by the second conveyor; it is deactivated or greatly reduced immediately before the front edge of the decelerated metal sheet bumps against the front edge stopper. If there is a magnetic device for deploying the holding action, an electromagnetic device is preferably used so that the retention force can be activated or deactivated by switching on and off electronically.

The holding action of the first holding device preferably acts continuously, meaning that it is not switched on. Exception: it is switched on for the last sheet of the lamellar flow.

In particular, it can be provided for the first and/or the second holding device to be made of at least one suction box underneath the first and/or the second conveyor. The suction box is preferably connected to a vacuum source through an on-off valve. In order for the suction to have an effect on the sheets through the first and/or second conveyor, the first and/or second conveyor is designed to be air-permeable.

The invention furthermore relates to a method for feeding flat objects that overlap in slats, particularly metal sheets, to at least a front edge stopper of a processing machine, particularly a tin printing machine or a tin-plate varnishing machine, with a first feeding zone, in which the objects arranged in slats are transported at the first constant speed, and with a second feeding zone following the first feeding zone, in which each frontmost object is taken at the first speed and then slowed down to the second speed, so that it is led with the second speed to at least a front edge stopper or nears the front edge stopper at this speed.

The second speed is much less than the first speed; it preferably exhibits a very small value, or the procedure is such that the sheet is decelerated to zero, and when it comes to a standstill, the front edge of the sheet bumps against the front edge stopper.

At a nominal speed corresponding to about 9,000 to 10,000 sheets per hour, the first speed can preferably be about 1 m/s. The second speed can exhibit a value of about 0.2 or 0.1 m/s, for example. In particular, the second speed can be set at 0.25 to 0.1 times the first speed.

BRIEF DESCRIPTION OF THE DRAWING

The drawing illustrates the invention by way of examples. To illustrate.

DETAILED DESCRIPTION

Figure 1:
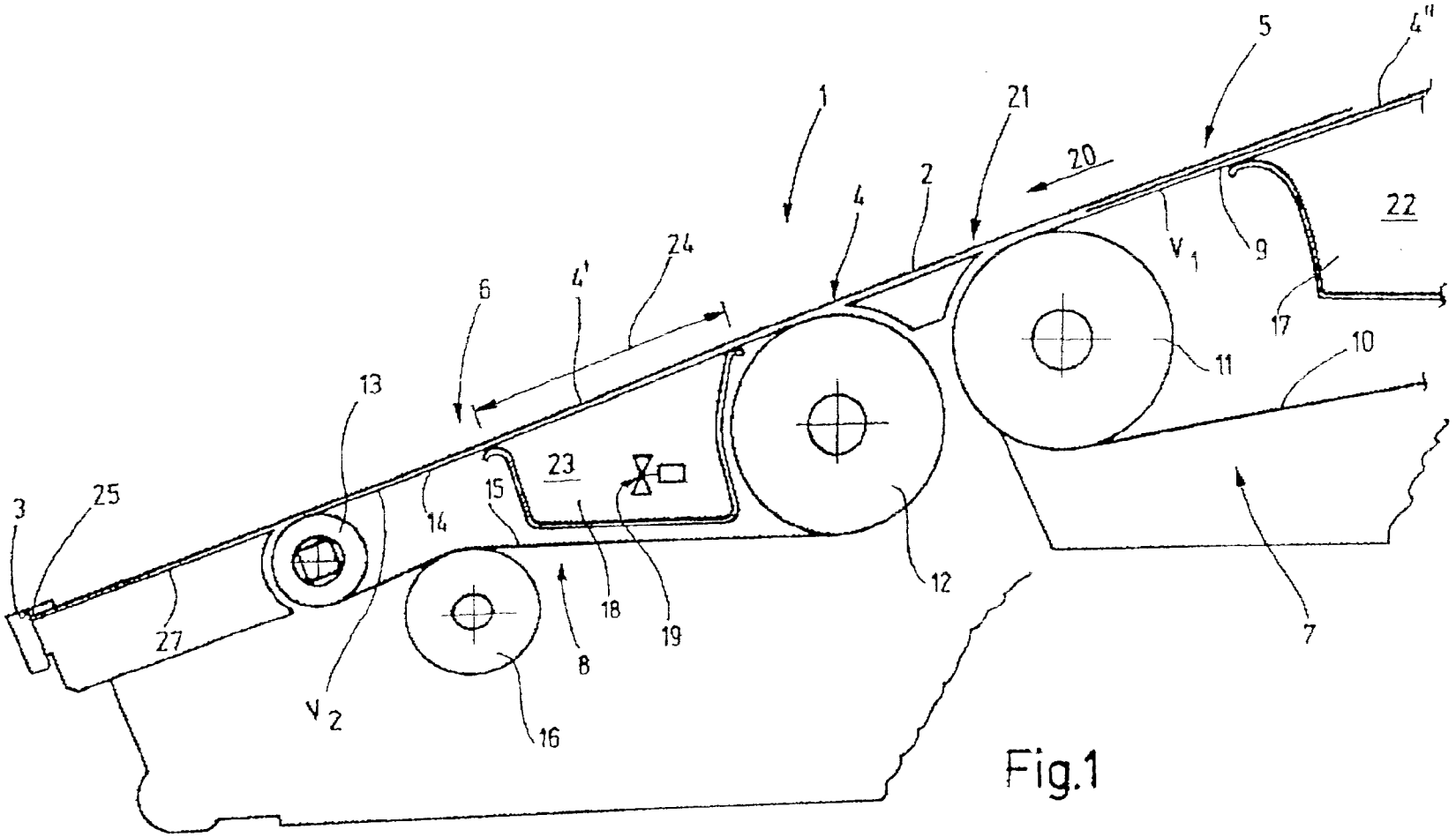
FIG. 1 is a side view of a device for feeding a metal sheet towards a front edge stopper.

FIG. 1 shows a device 1 for feeding flat objects 2 towards at least a front edge stopper 3. The objects 2 are designed as metal sheets 4. The device 1 exhibits a first conveyor 5 and a second conveyor 6. The first conveyor 5 is made of a rotating run 7 and the second conveyor 6 is made of a rotating run 8. The rotating run 7 has a top run 9 and a bottom run 10 and runs around a guide wheel 11 at one end. The guide wheel of the run 7 that lies on the other end is not shown in the figure for lack of space. The rotating run 8 has a guide wheel 12 or 13 at each end. Its top run 14 is at the level of the top run 9 and its bottom run 15 is routed over a tension roller 16. The rotating runs 7 and 8 each preferably consist of several belts at a distance to one another, in such a way that a support is formed, distributed over the width of the metal sheets. Corresponding guide wheels 11 to 13 as well as tension rollers 16 are allocated to the belts.

The belts of the runs 7 and 8 are designed to be air-permeable. Beneath the bottom run 9 is a suction box 17 indicated in the figure, with said suction box being connected to a vacuum source. Furthermore, beneath the top run 14 is a suction box 18, which is likewise connected to the vacuum source or to another vacuum source through an on-off valve 19. The runs 7 and 8 consequently form suction runs on which the objects are held rigidly through a vacuum.

The run 7 rotates preferably by means of an electric drive—not illustrated—at a constant, first speed $v_1$. The transport direction is identified by means of the arrow 20 with reference to a transport level 21. An electric or mechanical drive, whose speed can be regulated or controlled, drives the run 8 in such a way that it—likewise in the transport direction (arrow 20)—correspondingly accelerates and is decelerated. The present speed $v_2$ is shown.

FIG. 1 shows that the metal sheets 4 lie arranged in slats, meaning that the frontmost metal sheet 4' overlaps the subsequent metal sheet 4", in which the front edge section of the metal sheet 4" lies beneath the rear edge section of the metal sheet 4'. Other metal sheets following the subsequent sheet 4" upstream are correspondingly arranged in slats (not shown).

Figure 1A:
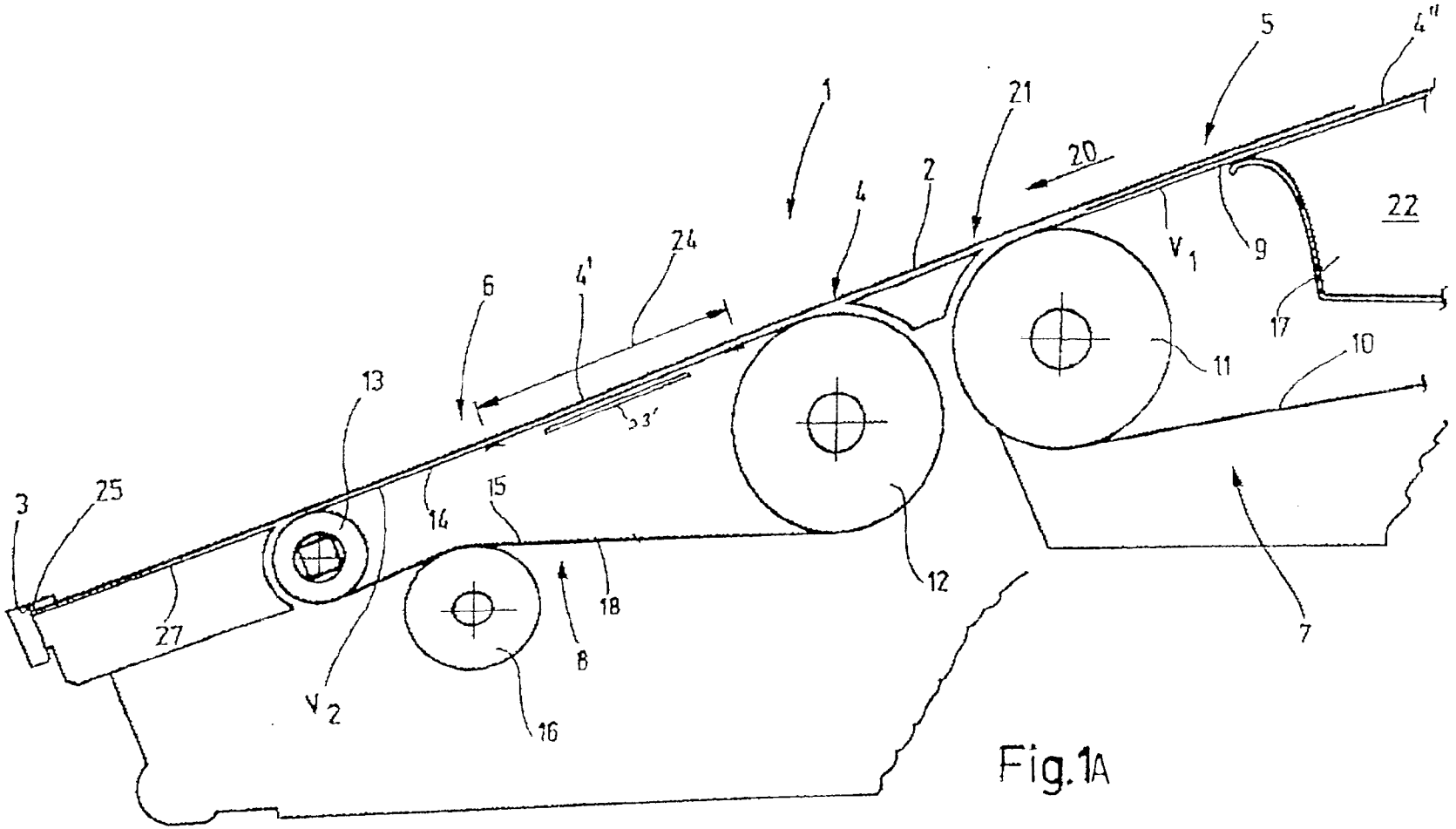
FIG. 1A is a side view of a similar device using a magnet.
Figure 2:
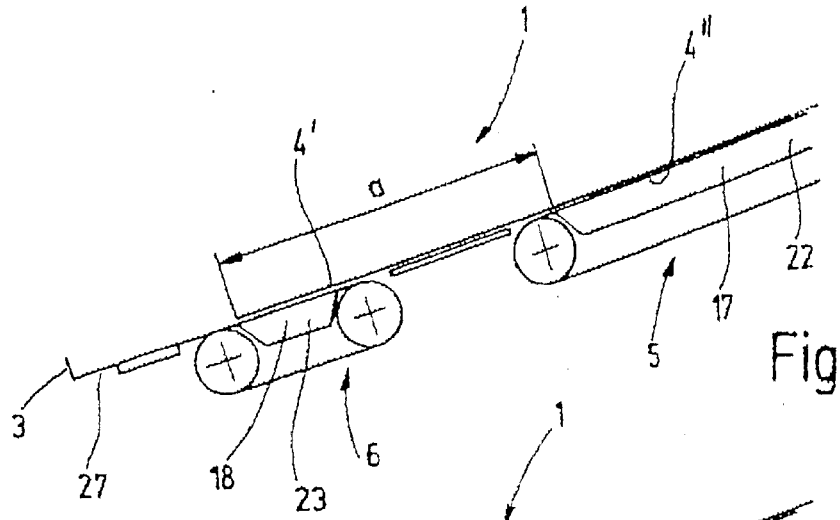
FIG. 2 is a schematic side view of the device according to FIG. 1.

The suction box 17 forms a first holding device 22, which locks the metal sheets 4 in position on the top run 9 in slats via a vacuum. The holding action of the first holding device 22 is constant. The suction box 18 forms a second holding device 23 for each frontmost metal sheet 4', in which the holding action can be switched on and off or intensified and reduced by means of the on-off valve 19, meaning that the vacuum source is connected to the suction box 18 or a separation of the connection follows. (FIG. 1A shows the same device as FIG. 1, but the suction box 18 forming the holding device and the valve 19, have been replaced with a magnet 23', which preferably may be turned off and on.)

As shown in the figure, the suction box 18 is arranged in the area of the power-side half with respect to the transport direction (arrow 20) of the rotating run 8. In this respect, the second holding device 23 stretches only over a section 24 of the entire length of the top run 14.

In the following, the metal sheets are generally marked with the reference numbers 4, with the frontmost metal sheet bearing the reference number 4' and the subsequent sheet the reference number 4".

The following function arises: The metal sheets 4, arranged in slats, are fed by means of the run 7. They lie on the top surface of the top run 9 and are locked in position through the effect of the vacuum of the suction box 17. The suction effect in the suction box 17 is constant; the speed $v_1$ is likewise constant. When the frontmost metal sheet 4' reaches the run 8 with its front edge section, the run takes over a corresponding, constantly enlarging section of the metal sheet 4'. With respect to the run 8, this takes place at the speed $v_1$, meaning that the runs 7 and 8 exhibit the same speed $v_1$ at this time ($v_1=v_2$). The vacuum affecting the corresponding metal sheet 4 is "switched off" by the subsequent sheet 4" through overlapping in the course of the process. Through a corresponding setting of the on-off valve 19, it is ensured that a vacuum is built up in the suction box 18 so that a section of the metal sheet 4' is firmly suctioned to the top surface of the top run 14 and the metal sheet 4' is consequently held in an immovable position to the top run 14. The build-up of the vacuum takes place only when the suction box 18 is completely covered by metal sheet 4'. The speed $v_2$ of the run 8 is then reduced by deceleration using the appropriate drive. During the slowdown process, the metal sheet 4' is held fast to the top run 14 by the vacuum so that no relative movement between the run 8 and the metal sheet 4' can occur. The delay of the run 8 takes place in such a way that the metal sheet 4' exhibits only a very low speed. At this state, its front edge 25 is still a little far from the front edge stopper 3. The vacuum of the suction box 18 is now switched off so that the metal sheet 4' is released and it slides over the base 27 until the front edge 25 bumps against the front end stopper 3. The base 27 stretches from the end of the run 8 away from the power to the front edge stopper 3. The metal sheet 4' is precisely aligned in this manner. During the braking process of the run 8, the run 7 continues to run unchanged with the speed $v_1$, so that the subsequent sheet 4" is pushed correspondingly further under the metal sheet 4'. When the frontmost metal sheet 4' is precisely aligned at the front edge stopper 3, it is seized at its front edge 25 and—in the transport direction (arrow 20)—is fed for further processing. Before the front edge stopper 3 is reached, the vacuum in the suction box 18 is switched off by activating the on/off valve 19. When the metal sheet 4' leaves the front edge stopper 3, the run 6 accelerates to the initial speed, or the speed $v_1$, so that the current, frontmost metal sheet 4 can be taken over by the run 6 in its front edge section, as was already previously explained using metal sheet 4'. The holding device 23 is then reactivated. The previously explained processes are carried out continuously so that the metal sheets 4 are processed and aligned in the process with a high cycle rate.

FIGS. 2 to 5 show the device of FIG. 1 in a schematic form, in which the following terms, such as "start" and "end" are defined from the point of view of the transport direction of the metal sheets 4, or in the direction of the arrow 20 of FIG. 1. Accordingly, as per FIG. 2, the distance a between the end of the second holding device 23 and the end of the first holding device 22, supplemented by a dimensioning tolerance that runs through the metal sheets in the time necessary for a complete vacuum build-up, is less than the slat length between the sheets. Slat length of the metal sheets 4 arranged in slats is understood as the measurement between the front end of a metal sheet 4 and the front end of the metal sheet 4 that immediately follows. On account of the mentioned distance a, a secure takeover of the metal sheets 4 from run 7 to run 8 is possible.

Figure 3:
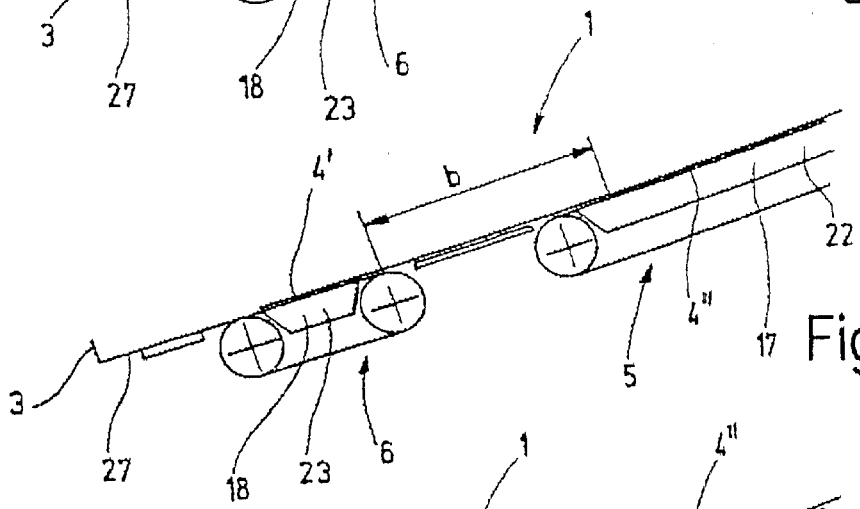
FIG. 3 is a schematic side view of the device of FIG. 1.

According to FIG. 3, the distance b between the start of the second conveyor and the front edge of a subsequent sheet 4" at the start of the slowdown process of the preceding sheet 4' is greater than the distance that the subsequent sheet 4" covers during the slowdown process of the preceding sheet 4'. If this were not the case, the subsequent sheet 4" would run into the second conveyor 6 during the slowdown process of the preceding sheet 4' and the brake applied in advance in an undefined manner.

Figure 4:
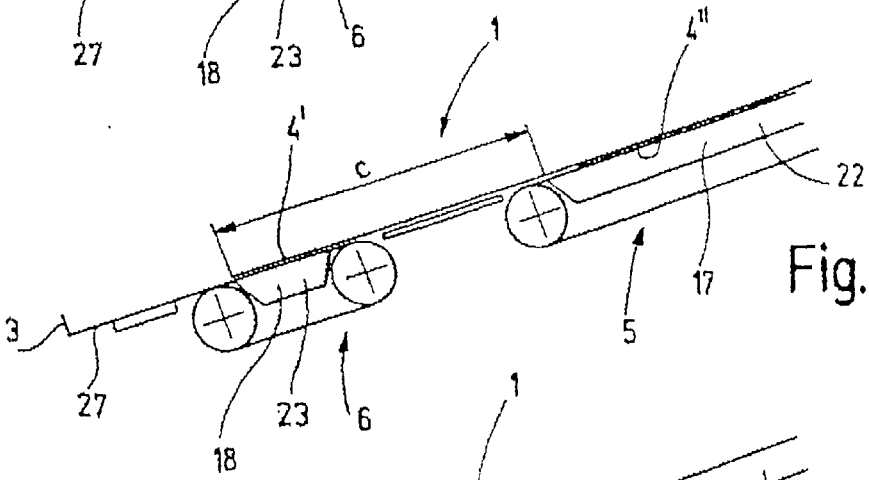
FIG. 4 is a schematic side view of the device of FIG. 1.

FIG. 4 shows that the distance c from the front edge of the preceding sheet 4' during the start of the slowdown to the end of the first holding device 22 is greater than the slat length. If this were not the case, the metal sheet 4 to be slowed down would still be driven at the same time by the first conveyor 5 (the subsequent sheet 4" must, at the start of the slowdown, go under the slat of the preceding sheet 4' at the conveyor 5, i.e., cover the suction box 17).

Figure 5:
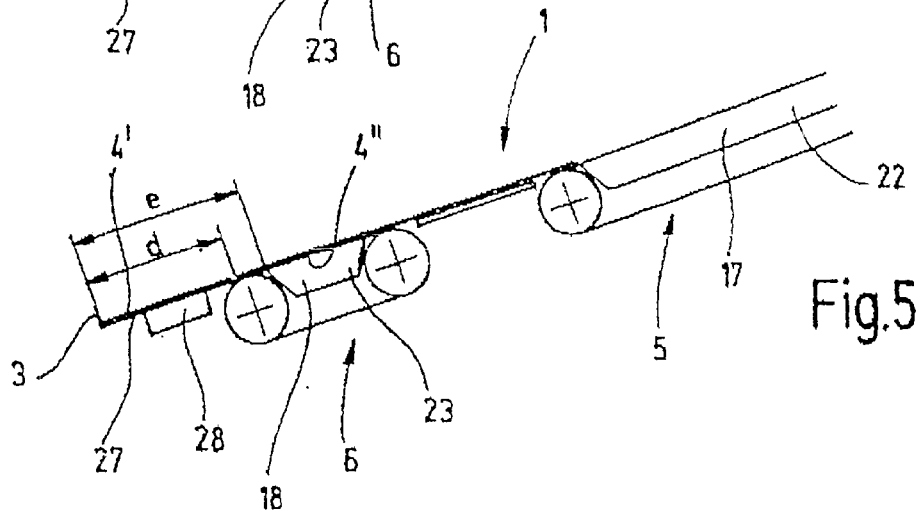
FIG. 5 is a schematic side view of the device of FIG. 1.

According to FIG. 5, it is provided for the distance between the front edge stopper 3 and the front edge of the subsequent sheet 4" (measurement d) at the time of switching on the vacuum (vacuum in the suction box 18) to be less than the distance from the front edge stopper 3 to the end of the second holding device 23 (measurement e). If this were not the case, the vacuum would catch the metal sheet 4, which is precisely the one that should be aligned. This must go under the preceding metal sheet 4' to be aligned when the vacuum is switched on (for the subsequent sheet 4").

In FIG. 5, as an alternative embodiment, a device with regard to reference number 28 is indicated, with said device taking over a slowed down metal sheet 4' after the vacuum of the suction box 18 is switched off. The takeover takes place with the delayed, very slight speed $v_2$. The device 28, which is only schematically indicated, leads the metal sheet 4' with further delay until it reaches the front edge stopper 3 so that a controlled, reproducible alignment occurs there.

The invention preferably relates consequently to a slowdown of the metal sheets in the phase of the feed of the particular front edge to an alignment stopper by means of rotating vacuum suction belts, in which each metal sheet delayed is grasped in a coupled manner. The slowdown takes place preferably at a speed $v_2$, which is about 10% of the speed $v_1$ or almost zero. A delay and re-acceleration of the vacuum belts follows, in which the acceleration to the sheet feed speed is carried out by the run introduced and this speed is held constant for the takeover of the sheet. Afterwards, the slowdown is carried out to a defined speed in order to drive the metal sheet carefully against the front edge stopper. By switching the vacuum on and off (switching on before sheet takeover and during the subsequent delay; switching off the vacuum before reaching the front edge stopper or before the re-acceleration of the suction belt to the sheet feed speed for the takeover of the next sheet), it is ensured that an uncontrolled displacement of the sheets does not occur. The sheet aligned at the front edge stopper is preferably delivered to a system that is not illustrated and not described so that the metal sheets can be processed further in a defined location. Through the invention, a high target braking accuracy or positioning accuracy is achieved by starting a speed path profile in the same manner for each sheet in the machine cycle. There is a scratch-free initiation of force to the sheets on account of the vacuum or of a magnetic hold.

The metal sheets 4, 4' are each slowed down completely flat. The surface of the slowing down device (second conveyor 6) lies in the sheet run surface. When switching off the vacuum at the end of the slowdown process, no movement occurs crosswise to the sheet run surface, particularly vertically to the sheet run surface, which could be detrimental to the precise arrangement of the metal sheets 4' to the front edge stopper 3.

In contrast to known, back and forth swing units with a vacuum head, the principle according to the invention of the rotating, continuous belt operation is advantageous in that there is no reverse stroke, which means considerably more time for a gentle slowdown free of back or sliding fiction, or the feed speed can be set at an altogether slower speed, which altogether benefits the secure function of the installation. Furthermore, a rotating belt run is advantageous with respect to a possible scratching of the underside of the metal sheets. During the slowdown, in which a great holding vacuum is necessary, no relative movement between the metal sheet 4' and the belts (second conveyor 6) occurs, thereby ruling out scratching. In the phase where the metal sheet 4' rests at a residual speed at the front edge stopper 3, preferably consisting of several front stoppers, the belts slip through (second conveyor 6) without a holding effect (vacuum or magnetic force is switched off) under the metal sheet 4'. Since the relative speed is furthermore very slight, no scratches develop as a result of the mentioned belt system. Worn-out belt surfaces can easily be eliminated by simply changing the belt at little cost. In view of the entire sheet arrangement, only one metal sheet at a time, namely the frontmost metal sheet 4', is slowed down according to the invention from the entire lamellar flow. The remaining lamellar flow continues to move. This is also of particular interest because the lamellar flow is designed in such a way that the frontmost sheet lies on the subsequent sheet. This means that the slowdown is carried out according to the invention from below because the underside of the metal sheets lie on the conveyor 5 or 6. This solution was chosen, although to keep the appropriate metal sheet 4' in place by means of a vacuum or magnetic force, only the section of the sheet, which is not in an overlapping position with respect to the subsequent sheet, is accessible from below.

What is claimed is:

1. A device for feeding metallic sheets which overlap in slats to a front edge stopper of a processing machine, the metallic sheets having a frontmost sheet with a front edge comprising:

a first conveyor for carrying the metallic sheets, the first conveyor having a first speed and a holding device for holding the a sheet passing over the first conveyer; and a second conveyor disposed adjacent the first conveyor and between the first conveyor and the front edge stopper, the second conveyor forming a continuously rotatable run configured for receiving the front end of the frontmost metallic sheet from the first conveyor at the first speed corresponding to that of the first conveyor and slowing the object down a second speed, slower than the first speed and for feeding the object to the front edge stopper, the second conveyor having a holding device which magnetically or pneumatically holds the front end of the frontmost sheet to the second conveyor as the front most sheet decelerates, to thereby allow a next sheet of the front most sheet to advance under the frontmost sheet while the front end is being held by the holding device; and wherein the holding device of the first conveyor and the holding device of the second conveyor are at a distance less than the slat length of sheets passing thereover so that each sheet is remains held securely by either the holding device of the first conveyor or the holding device of the second conveyor.

2. The device according to claim 1, wherein the holding device of the second conveyor comprises a magnet.

3. The device according to claim 1, wherein the holding device of the second conveyor comprises a vacuum which is selectively turned on when to engage the front edge of frontmost sheet.

4. The device according to claim 3, wherein the holding device of the second conveyor comprises a stationary vacuum which extends only over a section of the second conveyor.

5. The device according to claim 1, wherein the holding action of the holding device can be switched on and off.

6. The device according to claim 1, wherein the second conveyor has a power-side half and wherein the holding device is essentially found in the power-side half of the second conveyor.

7. The device according to claim 1, wherein the holding device of the second conveyor can be switched on and off.

8. The device according to claim 1, wherein the first conveyor is configured as a continuously rotating conveyor.

9. The device according to claim 1, wherein the first conveyor further comprises a holding device which is continuously on.

10. The device of claim 1, wherein at least one of the first conveyor and the second conveyor comprise a holding device formed by at least one suction box found beneath one of the first conveyor and the second conveyor.

11. The device according to claim 10, wherein the suction box is connected to a vacuum source through an on-off valve.

12. The device according to claim 11, wherein at least one of the first conveyor and the second conveyor is air-permeable.

13. A method for delivering flat, overlapping metal sheets to at least one leading edge stop of a processing machine selected from the group consisting of a sheet metal printing machine and a sheet metal lacquering machine, the method comprising:

conveying overlapping metal sheets on a first conveyer at a first constant speed;

taking a frontmost sheet of the overlapping sheets and moving said sheet in a second conveyer at a first speed and then decelerating said sheet to a second, slower speed, so that the sheet is led at the second speed toward at least one leading edge stop, whereby during its deceleration the frontmost sheet is held, beginning at its front region, in a holding zone in the second conveyer by partial vacuum or magnetic action, and terminating the holding action as soon as the leading edge of the frontmost sheet is located only a short distance from the leading edge stop, and whereby during deceleration of the frontmost sheet the next following sheet is transported at the first speed, thereby being pushed increasingly further underneath the frontmost sheet, and the holding action in the holding zone is turned on again as soon as said next following sheet bridges the holding zone in the second conveyor zone.

14. The method according to claim 13, wherein the second, slower speed is slightly greater than zero.

15. The method according to claim 14, wherein the second, slower speed is about 0.1 to 0.2 m/s.

16. The method according to claim 13, wherein the method further comprises holding the objects to at least one of the first conveyor and the second conveyor by suction.

17. The method according to claim 13, wherein the objects are held to both the first conveyor and the second conveyor during movement.

18. A method for delivering flat, overlapping metal sheets to at least one leading edge stop of a processing machine selected from the group consisting of a sheet metal printing machine and a sheet metal lacquering machine, the method comprising:

conveying overlapping metal sheets on a first conveyer at a first constant speed and subjecting the metal sheets to a holding device associated with the first conveyer;

taking a frontmost sheet of the overlapping sheets and moving said sheet in a second conveyer at a first speed and then decelerating said sheet to a second, slower speed, so that the sheet is led at the second speed toward at least one leading edge stop, whereby during its deceleration the frontmost sheet is held, beginning at its front region, in a holding zone in the second conveyer by partial vacuum or magnetic action, and terminating the holding action of the second conveyer as soon as the leading edge of the frontmost sheet is located only a short distance from the leading edge stop, and whereby during deceleration of the frontmost sheet the next following sheet is transported at the first speed, thereby being pushed increasingly further underneath the frontmost sheet, and the holding action in the holding zone is turned on again as soon as said next following sheet bridges the holding zone in the second conveyor zone; and whereby the sheets are held by the holding device of the first conveyer or the holding action of the second conveyer as they pass from the first conveyer to the second conveyer.

* * * * *